US008497820B2

(12) United States Patent
Goh et al.

(10) Patent No.: US 8,497,820 B2
(45) Date of Patent: Jul. 30, 2013

(54) DISPLAY DEVICE AND DRIVING METHOD THEREOF

(75) Inventors: Joon-Chul Goh, Hwaseong-si (KR); Young-Soo Yoon, Suwon-si (KR); Chong-Chul Chai, Seoul (KR)

(73) Assignee: Samsung Display Co., Ltd. (KR)

( * ) Notice: Subject to any disclaimer, the term of this patent is extended or adjusted under 35 U.S.C. 154(b) by 1178 days.

(21) Appl. No.: 12/265,385

(22) Filed: Nov. 5, 2008

(65) Prior Publication Data

US 2009/0315870 A1 Dec. 24, 2009

(30) Foreign Application Priority Data

Jun. 23, 2008 (KR) ..... 10-2008-0059041

(51) Int. Cl.
*G09G 3/30* (2006.01)

(52) U.S. Cl.
USPC ..... 345/76; 345/82; 315/169.3

(58) Field of Classification Search
USPC ..... 345/76, 82, 92, 208; 315/169.3
See application file for complete search history.

(56) References Cited

U.S. PATENT DOCUMENTS

| | | | | |
|---|---|---|---|---|
| 6,809,710 | B2 | 10/2004 | Prache et al. | |
| 7,307,605 | B2 | 12/2007 | Shimoda et al. | |
| 7,817,117 | B2 * | 10/2010 | Kimura | 345/76 |
| 8,049,684 | B2 * | 11/2011 | Kim | 345/76 |
| 8,054,253 | B2 * | 11/2011 | Yoo | 345/77 |
| 2005/0259093 | A1 | 11/2005 | Osame et al. | |
| 2006/0007074 | A1 | 1/2006 | Ono et al. | |
| 2006/0007215 | A1 | 1/2006 | Tobita et al. | |
| 2008/0036706 | A1 | 2/2008 | Kitazawa | |

FOREIGN PATENT DOCUMENTS

| | | |
|---|---|---|
| JP | 2006-011391 | 1/2006 |
| JP | 2006-098437 | 4/2006 |
| JP | 2008-040326 | 2/2008 |
| KR | 2005-0113706 | 12/2005 |
| KR | 2007-0019463 | 2/2007 |
| KR | 10-0739335 | 7/2007 |
| KR | 2008-0013730 | 2/2008 |

* cited by examiner

*Primary Examiner* — Abbas Abdulselam
(74) *Attorney, Agent, or Firm* — Innovation Counsel LLP

(57) ABSTRACT

The present invention relates to a display device and a driving method thereof. A display device in the present invention comprises: a capacitor connected between a first node and a second node; a switching transistor controlled by a first scanning signal and transmitting a data voltage to the first node; an emission control transistor controlled by a second scanning signal and transmitting a reference voltage to the second node; a driving transistor comprising a control terminal connected to the first node, an output terminal connected to the second node, and an input terminal; a driving control transistor controlled by a third scanning signal and transmitting a driving voltage to the input terminal of the driving transistor; and a light-emitting device connected to the second node. Accordingly, display contrast of a display device may be improved.

25 Claims, 4 Drawing Sheets

DISPLAY DEVICE AND DRIVING METHOD THEREOF

REFERENCE TO RELATED APPLICATION

This application claims priority and the benefit under 35 U.S.C. §119, to Korean Patent Application No. 10-2008-0059041 filed in the Korean Intellectual Property Office on Jun. 23, 2008, the entire contents of which are incorporated herein by reference.

BACKGROUND OF THE INVENTION

1. Field of the Invention

The present invention relates to a display device and a driving method thereof, and in particular an organic light emitting device.

2. Description of the Related Art

Typically, an active matrix flat panel display includes a plurality of pixels for displaying images, and it displays images by controlling the luminance of each pixel according to given display information. Among the active matrix flat panel display devices, an organic light emitting display is a self-emissive display device having the advantages of low power consumption, a wide viewing angle, and a high response speed. Therefore, the organic light emitting display is being spotlighted as a next-generation display device to surpass the popularity of liquid crystal display (LCD).

Each pixel of an organic light emitting device includes a light-emitting device, a driving transistor, a switching transistor for applying a data voltage to the driving transistor, and a capacitor for storing the data voltage. The driving transistor outputs a current whose magnitude depends on the data voltage applied from the switching transistor. The light-emitting device emits light whose intensity is a function of the driving transistor's output current. Thereby, a space image is displayed.

Transistors are thin film transistors (TFT), which may be classified according to the type of active layer as either amorphous silicon or crystalline silicon thin film transistors, wherein such crystalline can be poly-crystalline or micro-crystalline.

When a black image is needed, a light-emitting device may still emit light if current leaks into the driving transistor. The darkness, or the contrast ratio in a black state, is determined by the magnitude of the leakage current. Particularly, when the driving transistor is a crystalline silicon thin film transistor, the leakage current is increased and the contrast ratio may be decreased, thus deteriorating display quality. This is more severe in OLEDs than in LCDs. This invention provides a device and a method for bypassing the leakage current in dark image display.

The above information disclosed in this BACKGROUND section is only for better understanding of the invention, therefore, it may contain information that does not form prior art.

SUMMARY

This section summarizes some features of the invention but does not limit the aspects of the invention disclosed in this application.

A display pixel in the present invention includes: a capacitor connected between a first node and a second node; a switching transistor controlled by a first scanning signal and transmitting a data voltage to the first node; an emission control transistor controlled by a second scanning signal and transmitting a reference voltage to the second node; a driving transistor having a control terminal connected to the first node, an output terminal connected to the second node, and an input terminal; a driving control transistor controlled by a third scanning signal and transmitting a driving voltage to the input terminal of the driving transistor; and a light-emitting device, for example, an organic emitting device, connected to the second node.

output output outputs

A display device in the present invention includes: a plurality of data lines transmitting a data voltage; a plurality of scanning signal lines transmitting a scanning signal; a plurality of emission control scanning signal lines transmitting an emission control scanning signal; a plurality of inversion scanning signal lines transmitting an inversion scanning signal; and a plurality of pixels receiving the data voltage according to the scanning signal and displaying a luminance corresponding to the data voltage Each pixel includes: a capacitor connected between a first node and a second node; a switching transistor having a control terminal connected to the scanning signal line, an input terminal connected to the data line, and an output terminal connected to the first node; an emission control transistor controlled by the emission control scanning signal and connected between a reference voltage and the second node; a driving transistor including a control terminal connected to the first node, an output terminal connected to the second node, and an input terminal; a driving control transistor including a control terminal connected to the inversion scanning signal line, an input terminal connected to a driving voltage terminal, and an output terminal connected to the input terminal of the driving transistor; and a light-emitting device connected to the second node, wherein the scanning signal and the emission control scanning signal are different from each other.

outputoutput

A method for driving a display device including a capacitor connected between a first node and a second node, a switching transistor controlled by the first scanning signal, an emission control transistor controlled by the second scanning signal, a driving transistor having a control terminal connected to the first node, a driving control transistor controlled by the third scanning signal and connected to the driving transistor, and a light-emitting device connected to the second node according to an exemplary embodiment of the present invention comprises turning on the switching transistor and the emission control transistor and turning off the driving control transistor; turning off the switching transistor and turning on the emission control transistor and the driving control transistor to generate a current to the light-emitting device and the emission control transistor.

A method for driving a display device includes a capacitor connected between a first node and a second node, a switching transistor transmitting a data voltage to the first node, an emission control transistor transmitting a reference voltage to the second node, a driving transistor having a control terminal connected to the first node, a driving control transistor transmitting a driving voltage to the driving transistor, and a light-emitting device connected to the second node according to the present invention comprises connecting the first node to the data voltage and connecting the second node to the reference voltage; and disconnecting the first node from the data voltage and connecting the driving transistor to the driving voltage to have a driving current to the light-emitting device and have a bypass current to the emission control transistor.

According to the present invention, when a black image is displayed, a current going through an organic light emitting element may be minimized such that a contrast ratio of an organic light emitting device may be increased.

In addition, display characteristics may be improved such that it is only influenced by data voltages of the present frame, but not by data voltages of the previous frame.

DESCRIPTION OF REFERENCE NUMERALS INDICATING PRIMARY ELEMENTS IN THE DRAWINGS

300: display panel
400: scan driver
500: data driver
600: signal controller
CONT1: scan control signal
CONT2: data control signal
Cst: capacitor
Din: input image signal
Dout: output image signal
$D_1$-$D_m$: data line
$G_1$-$G_n$: scanning signal line
$Ga_i$: emission control scanning signal line
$/G_i$: inversion scanning signal line
$Vg_i$: scanning signal
$Vga_i$: emission control scanning signal
$/Vg_i$: inversion scanning signal
ICON: input control signal
$I_{LD}$: driving current of an organic light emitting element
Ibk: output current of an emission control transistor
LD: organic light emitting element
N1, N2: node
PX: pixel
Qd: driving transistor
Qdd: driving control transistor
Qbk: emission control transistor
Qs: switching transistor
Vdat: data voltage
Vdd: driving voltage
Vss: common voltage
Vrf: reference voltage
Vbk: intermediate voltage

DETAILED DESCRIPTION OF THE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

First, an organic light emitting device according to an exemplary embodiment of the present invention will be described with reference to FIG. 1 and FIG. 2.

Figure 1:
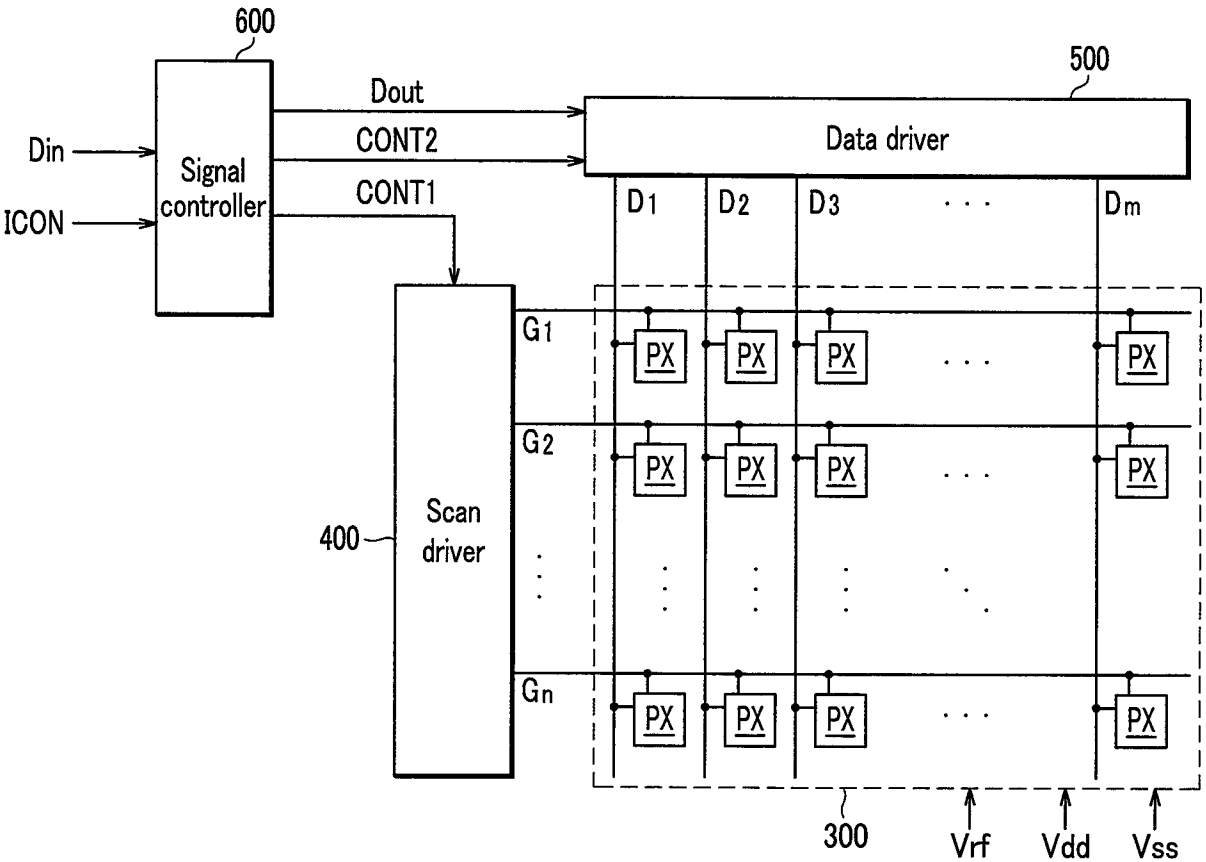
FIG. 1 is a block diagram of an organic light emitting device according to an exemplary embodiment of the present invention.
Figure 2:
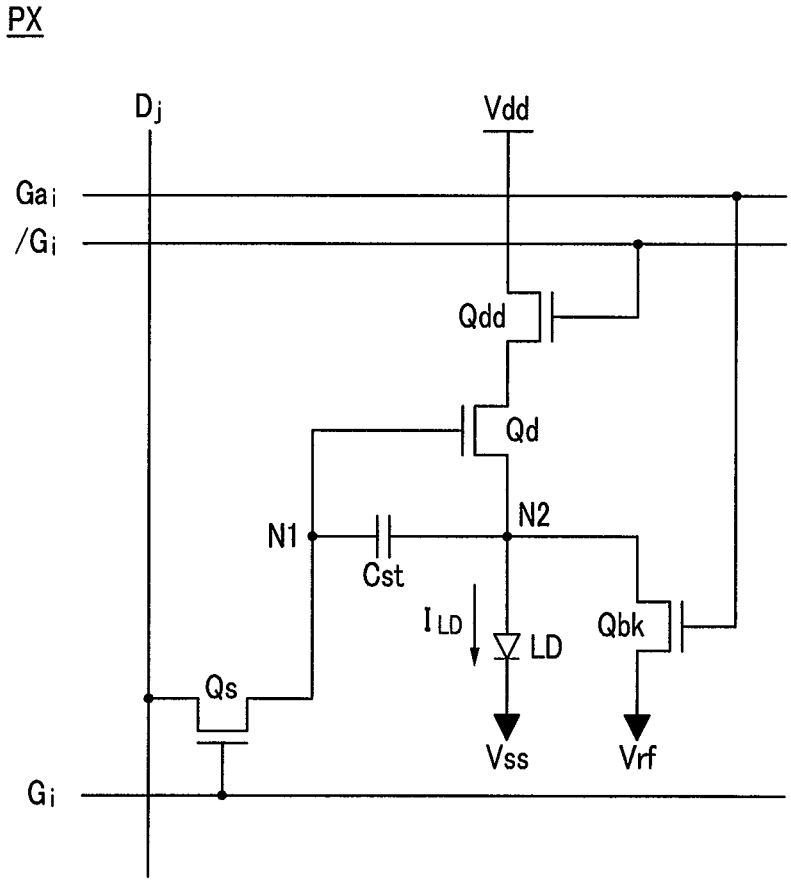
FIG. 2 is an equivalent circuit diagram of one pixel in an organic light emitting device according to an exemplary embodiment of the present invention.

FIG. 1 is a block diagram of an organic light emitting device according to an exemplary embodiment of the present invention, and FIG. 2 is an equivalent circuit diagram of one pixel in an organic light emitting device according to an exemplary embodiment of the present invention.

Referring to FIG. 1, an organic light emitting device according to an exemplary embodiment of the present invention includes a display panel 300, a scan driver 400, an inverter (not shown), a data driver 500, and a signal controller 600.

The display panel 300 includes a plurality of signal lines $G_1$-$G_n$, $D_1$-$D_m$, $Ga_i$, and $/G_i$ (i=1, 2, . . . , n), a plurality of voltage lines (not shown), and a plurality of pixels PX connected thereto and substantially arranged in a matrix.

The signal lines $G_1$-$G_n$, $D_1$-$D_m$, $Ga_i$, and $/G_i$ (i=1, 2, . . . , n) include a plurality of scanning signal lines $G_1$-$G_n$ for transmitting scanning signals, a plurality of emission control scanning signal lines $Ga_i$ for transmitting an emission control scanning signal, a plurality of inversion scanning signal lines $/G_i$ for transmitting an inversion scanning signal, and a plurality of data lines $D_1$-$D_m$ for transmitting data signals. The scanning signal lines $G_1$-$G_n$, $Ga_i$, and $/G_i$ extend substantially in a transverse direction and substantially parallel to each other, and the data lines $D_1$-$D_m$ extend substantially in a longitudinal direction and substantially parallel to each other. In some embodiments, the emission control scanning signal lines $Ga_i$ and the inversion scanning signal lines $/G_i$ may not be parallel to the scanning signal lines $G_1$-$G_n$ unlike what is shown in FIG. 2.

The voltage lines include a driving voltage line (not shown) for transmitting a driving voltage Vdd, a common voltage line (not shown) for transmitting a common voltage Vss, and a reference voltage line (not shown) for transmitting a reference voltage Vrf.

As shown in FIG. 2, each pixel PX includes an organic light emitting element LD, a driving transistor Qd, a capacitor Cst, a switching transistor Qs, an emission control transistor Qbk, and a driving control transistor Qdd.

Each of the driving transistor Qd, the switching transistor Qs, the emission control transistor Qbk, and the driving control transistor Qdd includes a control terminal, an input terminal, and an output terminal.

The control terminal of the driving transistor Qd is connected to the switching transistor Qs at a node N1, the input terminal thereof is connected to the driving control transistor Qdd, and the output terminal thereof is connected to the organic light emitting element LD at a node N2.

A control terminal of the switching transistor Qs is connected to a scanning signal line $G_i$ (i=1, 2, n), an input terminal thereof is connected to a data line $D_j$=1, 2, . . . , m), and an output terminal thereof is connected to a driving transistor Qd. The switching transistor Qs transmits a data voltage to the control terminal of the driving transistor Qd in response of the scanning signal from the scanning signal line $G_i$.

One terminal of the capacitor Cst is connected to the driving transistor Qd at the node N1, and the other terminal thereof is connected to the organic light emitting element LD at the node N2. The capacitor Cst stores the voltage difference between the control terminal and the output terminal of the driving transistor Qd during the time when a current flows in the organic light emitting element LD, and maintains it after the switching transistor Qs is turned-off.

A control terminal of the emission control transistor Qbk is connected to an emission control scanning signal line $Ga_i$, an input terminal thereof is connected to a driving transistor Qd at the node N2, and an output terminal thereof is connected to a reference voltage Vrf.

A control terminal of the driving control transistor Qdd is connected to the inversion scanning signal line $/G_i$, an input terminal thereof is connected to the driving voltage Vdd, and an output terminal thereof is connected to the organic light emitting element LD.

The switching transistor Qs, the driving transistor Qd, the emission control transistor Qbk, and the driving control transistor Qdd are n-channel field effect transistors (FETs). An example of the electric field effect transistor may be a thin film transistor (TFT), and it may include polysilicon or amorphous silicon. The channel types of the switching transistor Qs, the driving transistor Qd, the emission control transistor Qbk, and the driving control transistor Qdd may be reversed, and in this case, waveforms of the signals for driving them may be reversed as well.

The organic light emitting element LD, which may be an organic light emitting diode (OLED), includes an anode connected to the output terminal of the driving transistor Qd and a cathode connected to the common voltage Vss. The organic light emitting element LD emits light with different intensities according to the magnitude of a current $I_{LD}$ that is supplied by the driving transistor Qd, thereby displaying an image, and the magnitude of the current $I_{LD}$ depends on the magnitude of a voltage between the control terminal and the input terminal of the driving transistor Qd.

Again referring to FIG. 1 and FIG. 2, the scan driver 400 is connected to the scanning signal lines $G_1$-$G_n$ and the emission control scanning signal lines $Ga_i$ (i=1, 2, . . . , n) of the display panel 300. It applies a scanning signal consisting of a combination of a high voltage Von and a low voltage Voff to the scanning signal lines $G_1$-$G_n$ and also applies an emission control scanning signal consisting of a combination of a high voltage Von and an intermediate voltage Vbk to the emission control scanning signal lines $Ga_i$. Vbk is between the high Von and the low voltage Voff.

The scanning signal may be inverted at the inverter (not shown), which may be disposed in or out of the scan driver 400, and sent to the inversion scanning signal line $/G_i$.

Alternatively, an organic light emitting device according to another exemplary embodiment of the present invention may include a display panel 300, a scan driver 400, an inversion scan driver (not shown), an emission control scan driver (not shown), a data driver 500, and a signal controller 600.

In this case, the inverter (not shown) of the previous exemplary embodiment is not included. Unlike the previously-described exemplary embodiment, the inversion scan driver (not shown) and the emission control scan driver (not shown) may be respectively connected to the inversion scanning signal line $/G_i$ and the emission control scanning signal line $Ga_i$ as shown in FIG. 2. The inversion scan driver (not shown) applies an inversion scanning signal that is an inverse of the scanning signal of the scan driver 400 to the inversion scanning signal line $/G_i$, and the emission control scan driver (not shown) applies an emission control scanning signal consisting of a combination of the high voltage Von and the intermediate voltage Vbk to the emission control scanning signal line $Ga_i$.

The data driver 500 is connected to the data lines $D_1$-$D_m$, where data voltages are applied, of the display panel 300.

The signal controller 600 controls operations of the scan driver 400, the data driver 500, etc.

Each of the driving devices 400, 500, and 600 in FIG. 1, and the inversion scan driver (not shown) and the emission control scan driver (not shown), may be directly mounted on the display panel 300 in one or more IC chip form, or on a flexible printed circuit film (not shown) attached to the display panel 300 in a tape carrier package (TCP) form, or on a separate printed circuit board (PCB) (not shown). Alternatively, the driving devices 400, 500, and 600, in FIG. 1, and the inversion scan driver (not shown) and the emission control scan driver (not shown), may be integrated in the display panel 300 together with the signal lines $G_1$-$G_n$, $D_1$-$D_m$, $Ga_i$, and and $/G_i$ and the transistors Qs, Qd, Qdd, and Qbk. Another possible embodiment is to integrate the driving devices 400, 500, and 600, in FIG. 1, and the inversion scan driver (not shown) and the emission control scan driver (not shown), in a single chip, and leave one or more circuit elements containing them outside the single chip.

A display operation of the organic light emitting device will be described in detail with reference to FIG. 1 to FIG. 5.

Figure 3:
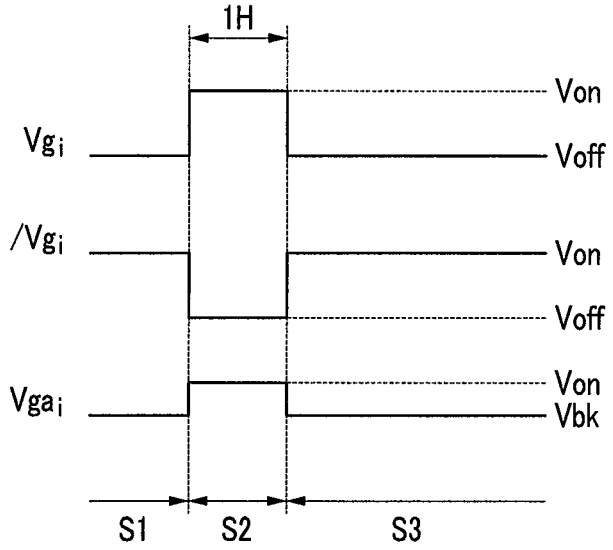
FIG. 3 is a waveform diagram showing driving signals applied to pixels of one row in an organic light emitting device according to an exemplary embodiment of the present invention.
Figure 4:
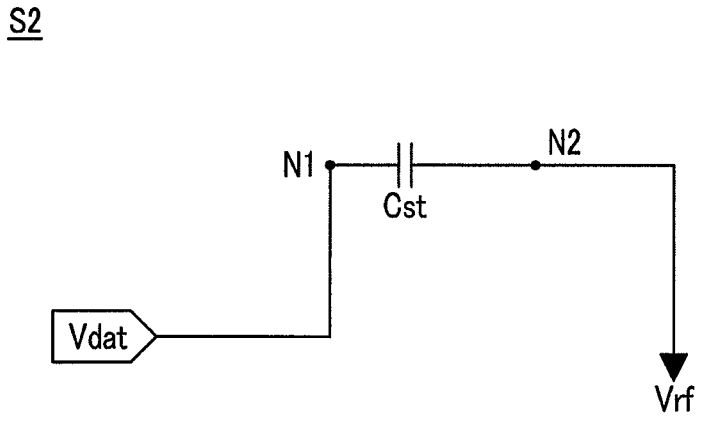
FIG. 4 and FIG. 5 are equivalent circuit diagrams of one pixel in periods S2 and S3 in FIG. 3, respectively.
Figure 5:
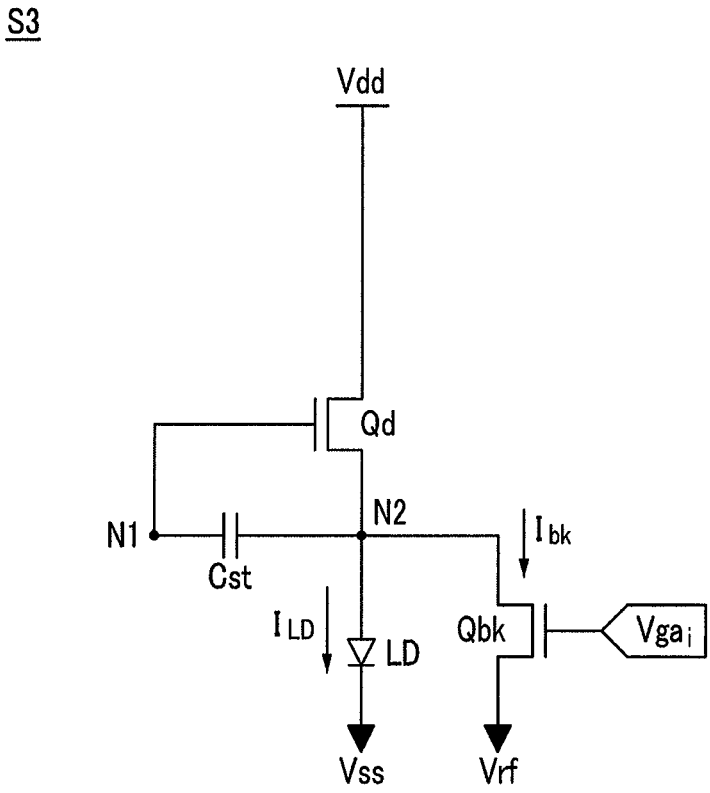

FIG. 3 is a waveform diagram showing driving signals applied to pixels of one row in an organic light emitting device according to an exemplary embodiment of the present invention. FIG. 4 and FIG. 5 are respective circuit diagrams of a single pixel corresponding to periods S2 and S3 in FIG. 3.

The signal controller 600 receives an input image signal Din and input control signals ICON for controlling a display of the input image signal Din from an external graphics controller (not shown). The input image signal Din contains luminance information for each pixel PX, and the luminance has gray scales of a given number, for example, 1024 ($=2^{10}$), 256 ($=2^8$), or 64 ($=2^6$). The input control signals ICON includes, for example, a vertical synchronization signal, a horizontal synchronizing signal, a main clock signal, and a data enabling signal.

The signal controller 600 appropriately processes the input image signal Din to correspond to an operating condition of the display panel 300 based on the input image signal Din and the input control signals ICON, and generates scanning control signals CONT1 and data control signals CONT2. The signal controller 600 sends the scanning control signals CONT1 to the scan driver 400, and sends the data control signals CONT2 and the output image signal Dout to the data driver 500.

The scanning control signals CONT1 may include a scanning start signal for instructing a start of scanning the high voltage Von to the scanning signal lines $G_1$-$G_n$ and the emission control scanning signal lines $Ga_i$, at least one clock signal for controlling an output period of the high voltage Von, and an output enable signal for defining a duration time of the high voltage Von.

The data control signals CONT2 may include a horizontal synchronization start signal for notifying a start of transmission of the digital image signal Dout for one row of pixels PX, a load signal for instructing application of analog data voltages to the data lines $D_1$-$D_m$, and a data clock signal.

The scan driver 400 sequentially changes the scanning signal $Vg_i$ and the emission control scanning signal $Vga_i$ that are respectively applied to the scanning signal lines $G_1$-$G_n$ and the emission control scanning signal line $Ga_i$ to a high voltage Von, and again changes them to the low voltage Voff and the intermediate voltage Vbk according to the scan control signals CONT1 from the signal controller 600.

According to the data control signals CONT2 from the signal controller 600, the data driver 500 receives a digital output image signal Dout for each row of pixels PX, converts the digital output image signal Dout to an analog data voltage Vdat, and then applies the analog data voltage Vdat to the data lines $D_1$-$D_m$.

Now, more detailed description regarding the i-th row of pixels during one frame will be provided. During the one frame, the scanning signal $Vg_i$ and the emission control scanning signal $Vga_i$ are applied to all the scanning signal lines $G_1$-$G_n$ and the emission control scanning signal lines $Ga_i$.

Referring to FIG. 3, when one frame starts, the scanning signal $Vg_i$ that is applied to the scanning signal line $G_i$ is a low voltage Voff, the emission control scanning signal $Vga_i$ applied to the emission control scanning signal line $Ga_i$ is an intermediate voltage Vbk, and the inversion scanning signal $/Vg_i$ that is applied to the inversion scanning signal line $/G_i$ is a high voltage Von. This period is an emission period S1 of the previous frame. In the case that the pixel row is the first (i=1) pixel row, the emission period S1 is omitted.

Next, the scanning signal $Vg_i$ applied to the scanning signal line $G_i$ and the emission control scanning signal $Vga_i$ applied to the emission control scanning signal line $Ga_i$ are changed to the high voltage Von, and simultaneously, the inversion scanning signal $/Vg_i$ applied to the inversion scanning signal line $/G_i$ is changed to the low voltage Voff. Accordingly, a charging period S2 of the present frame starts.

Then, as shown in FIG. 4 in view of FIG. 2, the switching transistor Qs and the emission control transistor Qbk are respectively turned on, and the driving control transistor Qdd is turned off. The data voltage Vdat is applied to node N1 through the turned-on switching transistor Qs (now conducting), and the reference voltage Vrf is applied to the node N2 through the turned-on emission control transistor Qbk (now conducting) such that an exact difference between the data voltage Vdat and the reference voltage Vrf is stored in the capacitor Cst.

Referring to FIG. 3, the scanning signal $Vg_i$ that is applied to the scanning signal line $G_i$ is changed to the low voltage Voff, and the inversion scanning signal $/Vg_i$ that is applied to the inversion scanning signal line $/G_i$ is changed to the high voltage Von such that an emission period S3 of the present frame starts. Simultaneously, the emission control scanning signal $Vga_i$ that is applied to the emission control scanning signal line $Ga_i$ is changed to the intermediate voltage Vbk. Then as shown in FIG. 5, in view of FIG. 2, the switching transistor Qs is turned off (now disconnected) and the driving control transistor Qdd is turned on (now conducting), such that a current comes to the node N2 from the driving transistor Qd. T The output current magnitude of the driving transistor Qd depends on the voltage across the capacitor Cst, equivalent to the voltage difference between two nodes N1 and N2. In the present exemplary embodiment, the voltage of the node N2 is renewed to the reference voltage Vrf in every frame in the charging period S2, so that the voltage at the node N2 in the previous frame does not influence the present frame, and the output current from the driving transistor Qd is determined only by the data voltage Vdat of the present frame, thereby improving the display characteristics.

On the other hand, in emission period S3, the emission control transistor Qbk maintains its turned-on state such that a current Ibk is output. The current Ibk changes with the voltage difference between the intermediate voltage Vbk at the control terminal and the reference voltage Vrf at the output terminal.

$$Ibk=K\times(Vbk-Vrf-Vth)^2 \quad \text{(Equation 1)}$$

In Equation 1, K is a characteristic constant of the emission control transistor Qbk, and Vth is a threshold voltage of the emission control transistor Qbk. Accordingly, a portion of the output current from the driving transistor Qd goes through the emission control transistor Qbk and the rest flows through the organic light emitting element LD.

Particularly, when the organic light emitting device has a black image to display, an appropriate intermediate voltage Vbk may be applied to the emission control transistor Qbk to control the current Ibk going through the emission control transistor Qbk so that the current $I_{LD}$ going through the organic light emitting element LD may be minimized, thereby increasing the contrast ratio. On the other hand, when an image of high luminance is displayed, the intermediate voltage Vbk is changed to a low voltage Voff that turns off the emission control transistor Qbk, so that the current $I_{LD}$ running in the organic light emitting element LD may be increased. The organic light emitting element LD emits light with different intensities according to a magnitude of the output current $I_{LD}$, thereby displaying a desired gray scale of an image.

By repeating this procedure by a unit of a horizontal period (also referred to as "1H" which is equal to one period of the horizontal synchronization signal and the data enabling signal), the respective scanning signals are sequentially applied to all scanning signal lines $G_1$-$G_n$, emission control scanning signal lines $Ga_i$, and inversion scanning signal lines $/G_i$. In addition, the data voltages Vdat are sequentially applied to all pixels PX to display a frame of image.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a capacitor connected between a first node and a second node;

a switching transistor controlled by a first scanning signal and transmitting a data voltage to the first node;

an emission control transistor controlled by a second scanning signal and transmitting a reference voltage to the second node;

a driving transistor comprising a gate terminal directly connected to the first node, an output terminal connected to the second node, and an input terminal;

a driving control transistor connected with the driving transistor in series and controlled by a third scanning signal and transmitting a driving voltage to the input terminal of the driving transistor; and a light-emitting device connected to the second node.

2. The display device of claim 1, wherein the light-emitting device is an organic light emitting device.

3. The display device of claim 1, wherein the first scanning signal and the second scanning signal are simultaneous in a first state, and the third scanning signal is in a second state such that the first node is applied with the data voltage and the second node is applied with the reference voltage.

4. The display device of claim 3, wherein, when the first scanning signal is in the second state, the switching transistor is turned off, and the third scanning signal is in the first state such that the driving voltage is transmitted to the driving transistor.

5. The display device of claim 4, wherein the third scanning signal is an inversion signal of the first scanning signal.

6. The display device of claim 4, wherein, when the first scanning signal is in the second state, the driving transistor outputs an output current and the light-emitting device has a driving current.

7. The display device of claim 6, wherein
the output current depends on the data voltage and the reference voltage.

8. The display device of claim 6, wherein,
when the first scanning signal is in the second state, the second scanning signal is in a third state such that the emission control transistor has a bypass current.

9. The display device of claim 8, wherein,
when displaying a black image, the driving current going in the light-emitting device is minimized.

10. A display device comprising
a plurality of data lines transmitting a data voltage,
a plurality of scanning signal lines transmitting a scanning signal,
a plurality of emission control scanning signal lines transmitting an emission control scanning signal,
a plurality of inversion scanning signal lines transmitting an inversion scanning signal, and
a plurality of pixels receiving the data voltage according to the scanning signal and displaying a luminance corresponding to the data voltage,
wherein each pixel comprises:
a capacitor connected between a first node and a second node;
a switching transistor comprising a control terminal connected to the scanning signal line, an input terminal connected to the data line, and an output terminal connected to the first node;
an emission control transistor controlled by the emission control scanning signal and connected between a reference voltage and the second node;
a driving transistor comprising a control terminal connected to the first node, an output terminal connected to the second node, and an input terminal;
a driving control transistor comprising a control terminal connected to the inversion scanning signal line, an input terminal connected to a driving voltage terminal, and an output terminal connected to the input terminal of the driving transistor; and
a light-emitting device connected to the second node,
wherein the scanning signal and the emission control scanning signal are different from each other.

11. The display device of claim 10, wherein
the light-emitting device is an organic light emitting device.

12. The display device of claim 10, wherein
the inversion scanning signal is an inverse of the scanning signal.

13. The display device of claim 12, wherein
when the scanning signal and the emission control scanning signal are simultaneously in a first state,
the first node is applied with the data voltage and the second node is applied with the reference voltage.

14. The display device of claim 13, wherein
when the scanning signal is in the second state and the inversion scanning signal is in the first state,
the driving transistor has an output current,
wherein the output current depends on a difference between the data voltage and the reference voltage.

15. The display device of claim 10, wherein,
when the emission control scanning signal is in the first state, the second node is applied with the reference voltage, and
when the emission control scanning signal is in the second state, the emission control transistor has a bypass current.

16. The display device of claim 10, wherein
the scanning signal line, the emission control scanning signal line, and the inversion scanning signal line are respectively connected to different drivers.

17. The display device of claim 10, wherein
at least two of the scanning signal line, the emission control scanning signal line, and the inversion scanning signal line are connected to the same driver.

18. The display device of claim 17, further comprising
an inverter inverting the scanning signal to apply it to the inversion scanning signal line.

19. A method for driving a display device comprising a capacitor connected between a first node and a second node, a switching transistor controlled by the first scanning signal, an emission control transistor controlled by the second scanning signal, a driving transistor comprising a control terminal connected to the first node, a driving control transistor controlled by the third scanning signal and connected to the driving transistor, and a light-emitting device connected to the second node, comprising:
turning on the switching transistor and the emission control transistor and turning off the driving control transistor; and
turning off the switching transistor and turning on the emission control transistor and the driving control transistor to output a current to the light-emitting device and the emission control transistor.

20. The method of claim 19, wherein
the third scanning signal is an inverse of the first scanning signal.

21. The method of claim 20, wherein,
in the turning on of the switching transistor and the emission control transistor and turning off of the driving control transistor, the first scanning signal and the second scanning signal are a turn-on voltage, and the third scanning signal is a turn-off voltage.

22. The method of claim 20, wherein,
in the turning off of the switching transistor and turning on of the emission control transistor and the driving control transistor,
the first scanning signal is a turn-off voltage,
the second scanning signal is a black voltage, and the third scanning signal is a turn-on voltage.

23. The method of claim 22, wherein
the black voltage is higher than the turn-off voltage and lower than the turn-on voltage.

24. A method for driving a display device comprising a capacitor connected between a first node and a second node, a switching transistor transmitting a data voltage to the first node, an emission control transistor transmitting a reference voltage to the second node, a driving transistor comprising a control terminal connected to the first node, a driving control transistor transmitting a driving voltage to the driving transistor, and a light-emitting device connected to the second node, the method comprising:
connecting the first node to the data voltage and connecting the second node to the reference voltage; and
disconnecting the first node from the data voltage and connecting the driving transistor to the driving voltage to output a driving current to the light-emitting device and flow a bypass current to the emission control transistor.

25. The method of claim 24, wherein,
when the display device displays a black image, the driving current is minimized.

* * * * *